US011190873B2

(12) United States Patent
Son et al.

(10) Patent No.: US 11,190,873 B2
(45) Date of Patent: Nov. 30, 2021

(54) ELECTRONIC DEVICE AND METHOD FOR DETECTING BLOCKED STATE OF MICROPHONE

(71) Applicant: Samsung Electronics Co., Ltd., Gyeonggi-do (KR)

(72) Inventors: Beakkwon Son, Gyeonggi-do (KR); Youngsoo Park, Gyeonggi-do (KR); Keunwon Jang, Gyeonggi-do (KR); Gangyoul Kim, Gyeonggi-do (KR); Yangsu Kim, Gyeonggi-do (KR); Hangil Moon, Gyeonggi-do (KR); Kyoungho Bang, Gyeonggi-do (KR); Soonho Baek, Gyeonggi-do (KR); Gunwoo Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/783,424

(22) Filed: Feb. 6, 2020

(65) Prior Publication Data

US 2020/0260182 A1 Aug. 13, 2020

(30) Foreign Application Priority Data

Feb. 8, 2019 (KR) ..... 10-2019-0015177

(51) Int. Cl.
*H04R 3/00* (2006.01)
*H04R 29/00* (2006.01)

(52) U.S. Cl.
CPC ..... *H04R 3/005* (2013.01); *H04R 29/006* (2013.01); *H04R 2430/20* (2013.01); *H04R 2499/11* (2013.01)

(58) Field of Classification Search
CPC ..... G10L 2021/02165; H04R 2430/20; H04R 2499/11; H04R 29/004; H04R 29/006; H04R 3/005
(Continued)

(56) References Cited

U.S. PATENT DOCUMENTS 8,374,362 B2 2/2013 Ramakrishnan et al.
8,379,876 B2 2/2013 Zhang
(Continued)

FOREIGN PATENT DOCUMENTS

JP 4981975 B2 7/2012

OTHER PUBLICATIONS

International Search Report dated May 20, 2020.

*Primary Examiner* — Vivian C Chin
*Assistant Examiner* — Friedrich Fahnert
(74) *Attorney, Agent, or Firm* — Cha & Reiter, LLC

(57) ABSTRACT

An electronic device according to an embodiment may include: a first sound input device configured to obtain external sound and produce a first signal and a processor operatively connected to the first sound input device. The processor may be configured to: receive the first signal from the first sound input device; produce a first high-frequency signal by passing the first signal through a high-pass filter to; determine a first energy value of the first high-frequency signal; determine a second energy value of the first signal; compare a product of the second energy value of the first signal and the first energy value of the first high-frequency signal with a first threshold value to produce a first result; and determine whether the first sound input device is blocked based on the first result. In addition, various other embodiments may be provided.

19 Claims, 19 Drawing Sheets

(58) Field of Classification Search
USPC ..... 381/26, 71.6, 92, 94.2; 700/94
See application file for complete search history.

(56) References Cited

U.S. PATENT DOCUMENTS

| | | | | |
|---|---|---|---|---|
| 10,034,092 | B1 * | 7/2018 | Nawfal | H04R 5/04 |
| 2009/0196429 | A1 | 8/2009 | Ramakrishnan et al. | |
| 2012/0197420 | A1 | 8/2012 | Kumakura et al. | |
| 2015/0172816 | A1 | 6/2015 | Ivanov et al. | |
| 2015/0334489 | A1 | 11/2015 | Iyengar et al. | |
| 2018/0139554 | A1 | 5/2018 | Yang et al. | |
| 2020/0105291 | A1 * | 4/2020 | Sheaffer | H04R 3/10 |

* cited by examiner

ELECTRONIC DEVICE AND METHOD FOR DETECTING BLOCKED STATE OF MICROPHONE

CROSS-REFERENCE TO RELATED APPLICATION(S)

This application is based on and claims priority under 35 U.S.C. 119 to Korean Patent Application No. 10-2019-0015177, filed on Feb. 8, 2019, in the Korean Intellectual Property Office, the disclosure of which is herein incorporated by reference in its entirety.

BACKGROUND

1) Field

One or more embodiments disclosed herein generally relate to an electronic device and, for example, to a method of detecting whether or not a microphone is blocked in the electronic device that includes at least one microphone.

2) Description of Related Art

With the development of mobile communication and hardware/software technology, portable electronic devices such as smart phones (hereinafter, referred to as an "electronic device") have evolved into devices that may perform a variety of functions. The electronic device, for example, may obtain a sound signal of the user's voice by using a microphone (or a sound input device), and may transmit the signal containing the user's voice to a counterpart electronic device during a voice call.

The user may unintentionally block the microphone with his or her finger during the voice call. In this case, the voice of the user may not be transmitted to the other party.

The above information is presented as background information only to assist with an understanding of the disclosure. No determination has been made, and no assertion is made, as to whether any of the above might be applicable as prior art with regard to the disclosure.

SUMMARY

An electronic device according to an embodiment may include: a first sound input device configured to obtain external sound and produce a first signal; and a processor operatively connected to the first sound input device, where the processor is configured to: receive the first signal from the first sound input device; pass the first signal through a first high-pass filter to produce a first high-frequency signal; determine a first energy value of the first high-frequency signal; determine a second energy value of the first signal; compare a product of the second energy value of the first signal and the first energy value of the first high-frequency signal with a first threshold value to produce a first result; and determine whether the first sound input device is blocked based on the first result.

An electronic device according to an embodiment may include: a display; a memory; a sound output device; a first sound input device configured to obtain external sound and produce a first signal; a second sound input device configured to obtain external sound and produce a second signal; and a processor operatively connected to the display, the memory, the sound output device, the first sound input device, and the second sound input device, where the processor is configured to: receive the first signal from the first sound input device; compare a first value, produced based on a first high-frequency signal obtained by passing the first signal through a first high-pass filter, with a first threshold value to produce a first result; compare a second value, produced based on a first low-frequency signal obtained by passing the first signal through a low-pass filter, with a second threshold value to produce a second result; determine whether the first sound input device is blocked based on the first result and the second result; and when the first sound input device is blocked in a blocked state, provide feedback corresponding to the blocked state using the display and/or the sound output device.

A method of detecting whether a microphone of an electronic device is blocked, according to an embodiment, may include: obtaining external sound using a first sound input device and produce a first signal; passing the first signal through a high-pass filter to produce a first high-frequency signal; determining a first energy value of the first high-frequency signal; determining a second energy value of the first signal; comparing a product of the second energy value of the first signal and the first energy value of the first high-frequency signal with a first threshold value to produce a first result; and determining whether the first sound input device is blocked based on the first result.

Additional aspects will be set forth in part in the description which follows and, in part, will be apparent from the description, or may be learned by practice of the presented embodiments.

BRIEF DESCRIPTION OF THE DRAWINGS

For a more complete understanding of the disclosure and its advantages, reference is now made to the following description taken in conjunction with the accompanying drawings, in which like reference numerals represent like parts.

DETAILED DESCRIPTION

Certain embodiments disclosed herein have the objective of accurately detecting whether or not the microphone is blocked by the user during a voice call and provide feedback thereof to the user.

One or more embodiments disclosed herein may provide an electronic device capable of accurately detecting a blocked state of a microphone by the user's finger during a voice call and providing feedback thereof to the user, and a method of detecting the blocked state of the microphone of the electronic device.

Figure 1:
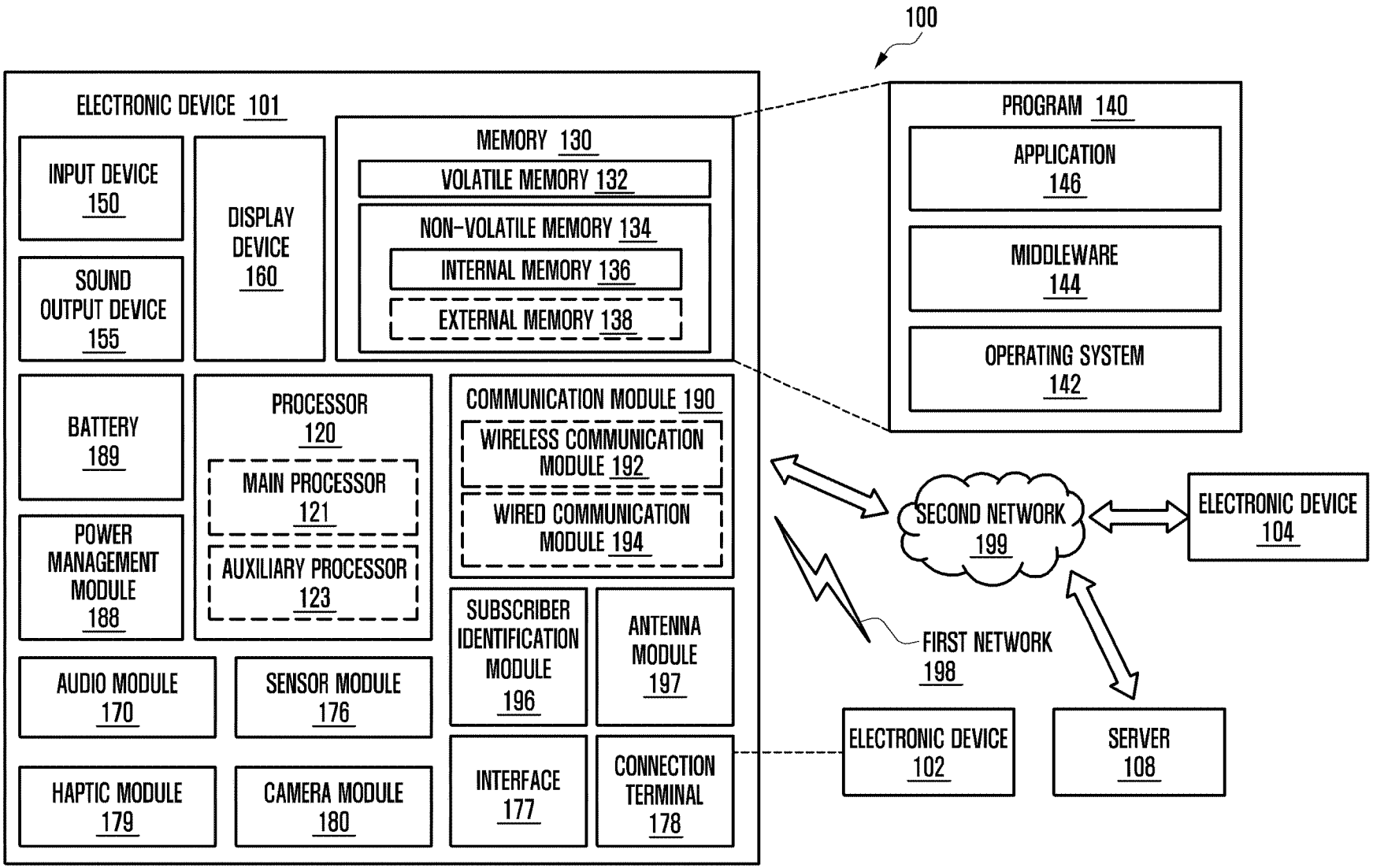
FIG. 1 illustrates an electronic device in a network environment in the various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
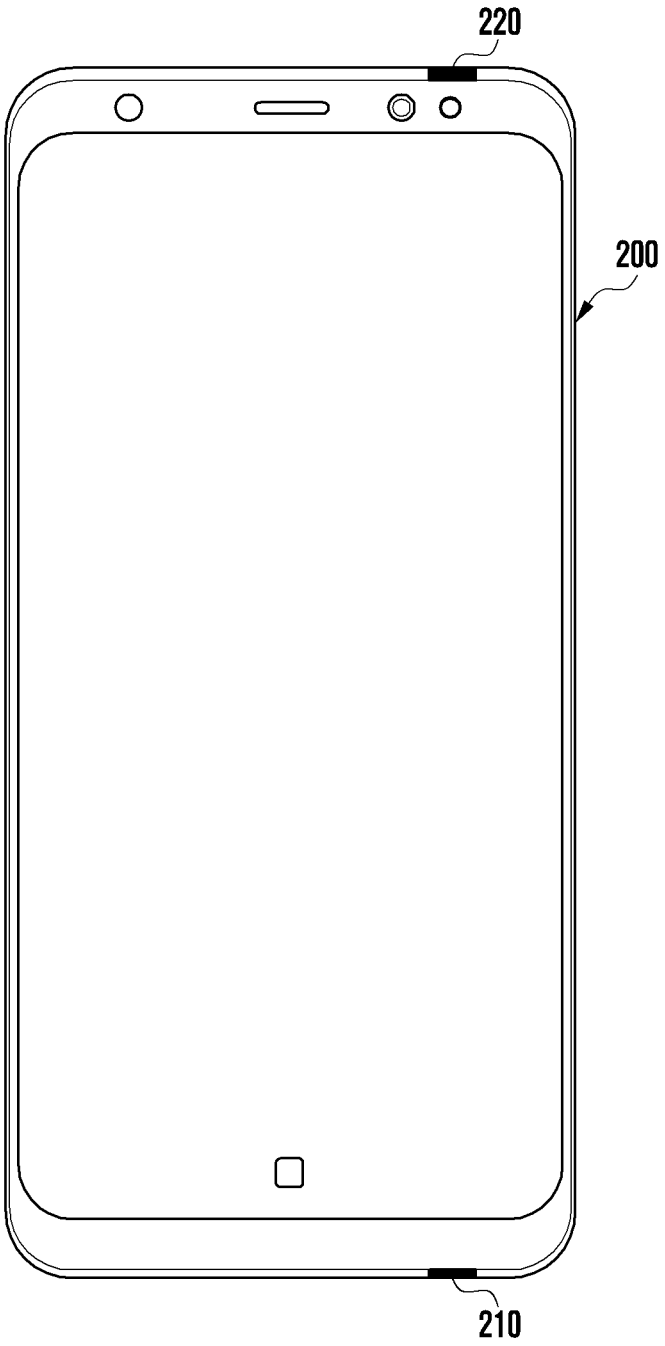
FIG. 2 is a view illustrating the outer appearance of an electronic device according to an embodiment.

FIG. 2 is a view illustrating the outer appearance of an electronic device according to an embodiment.

According to an embodiment, the electronic device 200 may include one or more sound input devices (e.g., a first sound input device 210 and a second sound input device 220) capable of collecting external sounds and producing sound signals. The sound input device may collect analog sounds, and may convert the same into digital sound signals. To this end, the sound input device may include an analog-to-digital (A/D) converter (not shown), and the A/D converter may be implemented as hardware and/or software. The sound input device may be implemented as a microphone known in the art, and may include some of the configuration and/or functions of the microphone of the input device 150 in FIG. 1.

Referring to FIG. 2, the electronic device 200 may include two sound input devices 210 and 220. For example, the first sound input device 210 may be provided at the lower end of the electronic device 200, and the second sound input device 220 may be provided at the upper end of the electronic device 200. The first sound input device 210 and/or the second sound input device 220 may be exposed to the outside through holes provided in a housing of the electronic device 200, which allows the sound input devices to collect a variety of sounds generated from the outside (e.g., the user's voice).

According to different embodiments, the number of sound input devices and the locations of the sound input devices are not limited to the example shown in FIG. 2.

According to an embodiment, the electronic device 200 may collect the user's voice using a sound signal (e.g., a first signal) obtained by the first sound input device 210 during a voice call, and may transmit the user's voice to a counterpart electronic device (not shown). The electronic device 200 may perform a variety of signal processing, such as noise removal, on the sound signal obtained from the first sound input device 210 using a sound signal obtained by the second sound input device 220, and may then transmit the same to the counterpart electronic device (e.g., the electronic device 104 in FIG. 1) through a communication module (e.g., the communication module 190 in FIG. 1).

Figure 3A:
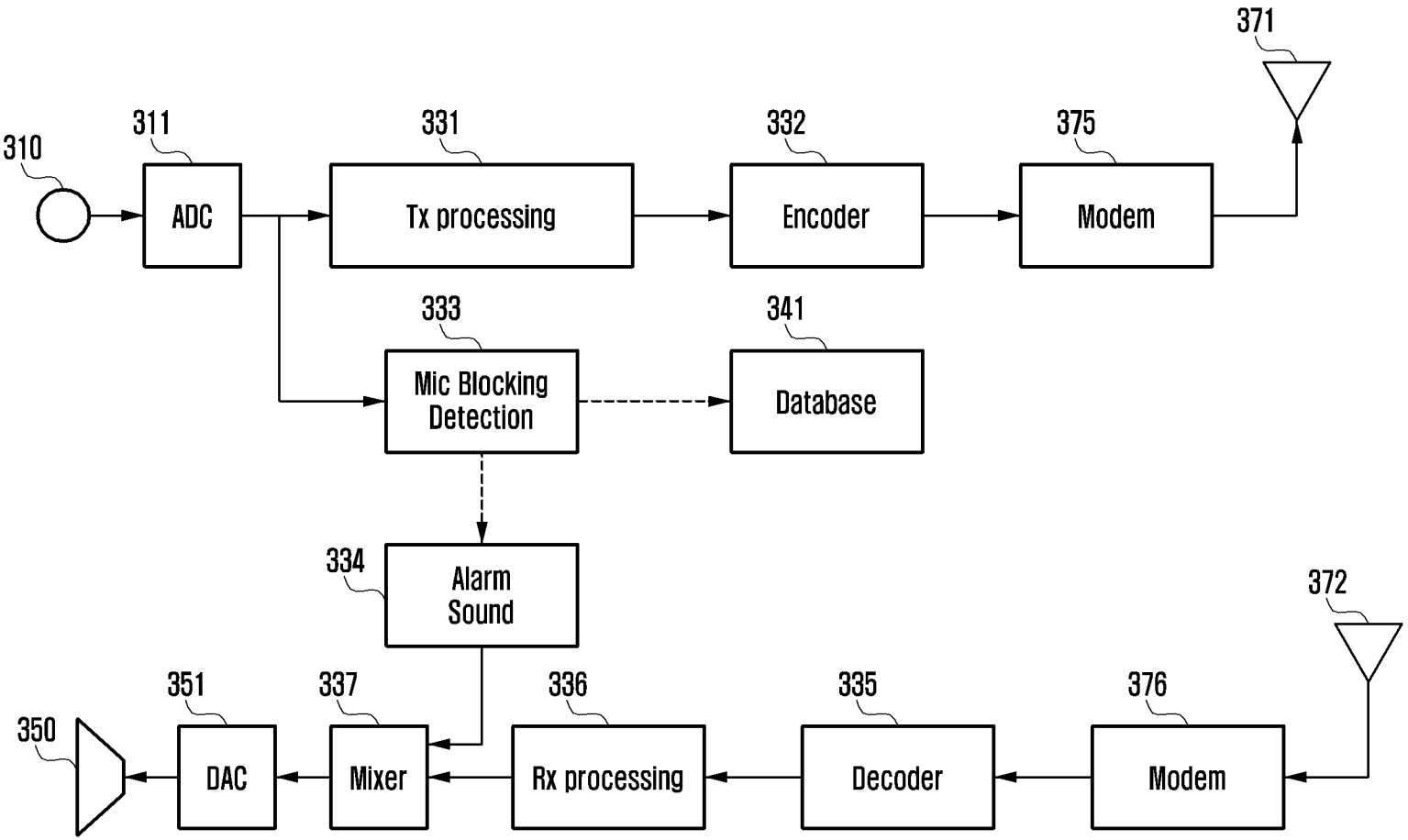
FIG. 3A is a block diagram of an electronic device according to an embodiment.
Figure 3B:
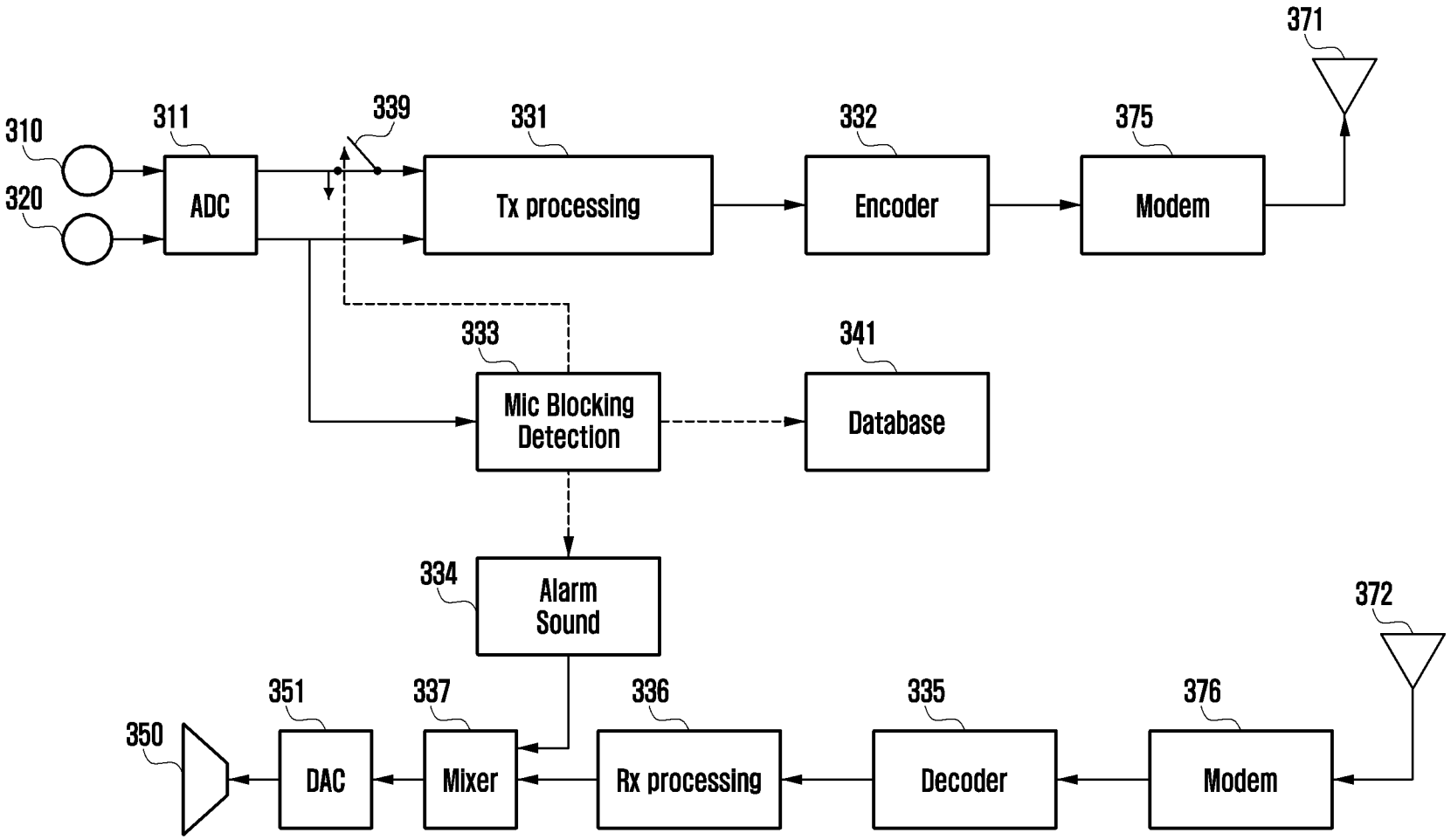
FIG. 3B is a block diagram of an electronic device according to another embodiment.

FIG. 3A is a block diagram of an electronic device according to an embodiment and FIG. 3B is a block diagram of an electronic device according to another embodiment.

FIGS. 3A and 3B illustrate different configurations that may be used for voice calls, but the configuration of the electronic device is not limited thereto.

FIG. 3A illustrates an embodiment in which the electronic device includes a single sound input device 310 or in which although the electronic device includes a plurality of sound input devices (e.g., the first sound input device 210 and the second sound input device 220 in FIG. 2), only one sound input device 310 is used for voice calls.

The sound input device 310 may collect external sounds (e.g., the user's voice) to then produce sound signals. An A/D converter 311 may convert the analog sound signal obtained by the sound input device 310 into a digital signal (e.g., a first signal). The first signal converted by the A/D converter 311 may be transmitted to a TX processor 331 and a block detector 333.

The TX processor 331 may perform a variety of signal processing on the first signal input thereto. For example, the signal processing may include various signal processing techniques, such as gain adjustment, filtering, dynamic range compressing by using a dynamic range compressor (DRC), noise removal by using a noise suppressor, echo cancellation by using an echo canceller, etc.

The first signal processed by the TX processor 331 may be encoded by an encoder 332, may be modulated by a modem 375, and may be transmitted as an RF band signal, through a TX antenna 371.

The electronic device may contemporaneously receive a voice signal from the counterpart electronic device (e.g., the electronic device 104 in FIG. 1).

The RX antenna 372 may receive an RF signal including the sound signal of the counterpart electronic device. The RX antenna 372 may be a separate antenna from the TX antenna 371, or the two may be a TX/RX combined antenna. The RF signal received by the RX antenna 372 may be demodulated to a base band signal by a modem 376, and may be decoded by a decoder 335. An RX processor 336 may perform signal processing on the input sound signal in various ways. For example, the signal processing may include various signal processing techniques, such as gain adjustment, filtering, dynamic range compressing by using a dynamic range compressor (DRC), etc.

The signal processed by the RX processor 336 may be converted to an analog signal by a D/A converter 351, and the voice of the counterparty may be output by a sound output device 350 (e.g., a receiver).

According to an embodiment, the electronic device may include a block detector 333 for detecting whether or not the sound input device 310 is blocked. The block detector 333 may detect whether or not the sound input device 310 is blocked based on the first signal input from the A/D converter 311. The user may unintentionally block the sound input device 310 with his or her finger during a voice call using the electronic device. In this case, the voice of the user may not be transmitted to the other party. The block detector 333 may detect that the sound input device is blocked by the user's finger or an external object as described above.

Certain embodiments in which the block detector 333 detects whether or not the sound input device 310 is blocked will be described in more detail with reference to FIGS. 4 to 10.

If the block detector 333 detects that the sound input device is blocked, a block event related to the same may be stored in a database 341. According to an embodiment, the database 341 may be stored in a memory (e.g., the memory 130 in FIG. 1) of the electronic device. Alternatively, the database 341 may be stored in a memory of an external server (e.g., the server 108 in FIG. 1), and the electronic device may transmit block events to the external server.

If the block detector 333 detects that the sound input device 310 is blocked, the electronic device may provide the user with feedback through a display (e.g., the display device 160 in FIG. 1) or the sound output device 350. For example, the electronic device may produce a predetermined sound alarm 334 to inform that the sound input device 310 is blocked. The produced sound alarm 334 may be mixed with the sound signal of the counterpart electronic device, which was processed by the RX processor 336, by a mixer 337 to then be output through the sound output device 350. Alternatively, the electronic device may process the sound alarm separately from the sound signal of the counterpart electronic device, and then output the sound alarm through another sound output device (e.g., a speaker), instead of the sound output device 350.

FIG. 3B illustrates an embodiment in which the electronic device includes two sound input devices. In FIG. 3B, descriptions of component similar to those in FIG. 3A will be omitted.

Referring to FIG. 3B, the electronic device may include a first sound input device 310 and a second sound input device 320. As shown in FIG. 2, the first sound input device 310 may be provided at the lower end of the housing of the electronic device, and the second sound input device 320 may be provided at the upper end of the housing of the electronic device.

The first sound input device 310 may collect external sounds (e.g., the user's voice) to produce a first signal, and the second sound input device 320 may collect external sounds to produce a second signal. The electronic device may convert the first signal and the second signal into respective digital signals using the A/D converter 311, and may then process the same in various ways using the TX processor 331.

When the user performs a voice call using the electronic device, the first sound input device 310 located at the lower end of the housing of the electronic device may be closer to the user's mouth. Thus, the first sound input device 310 may better capture the user's voice as compared to the second sound input device 320, while both the first sound input device 310 and the second sound input device 320 may receive environmental sounds surrounding the user at similar magnitudes. The TX processor 331 may use the second signal from the second sound input device 320 to further process the first signal, such as noise removal, echo cancellation, etc. The signal processed by the TX processor 331 may be transmitted to the counterpart electronic device via the encoder 332, the modem 375, and the TX antenna 371.

According to an embodiment, the electronic device may include a block detector 333 for detecting whether or not the first sound input device 310 and/or the second sound input device 320 are blocked. The block detector 333 may make such a determination based on the first and second signals.

Certain embodiments in which the block detector 333 detects whether or not the sound input device is blocked will be described in more detail with reference to FIGS. 4 to 10.

Referring to FIG. 3B, the electronic device may include a switch 339 provided between the A/D converter 311 and the TX processor 331. The switch 339 may close the path for the first signal to be transmitted to the TX processor 331 during a voice call, and may open the path such that the first signal is not transmitted to the TX processor 331 if it is identified that the first sound input device 310 is blocked, as detected by the block detector 333. This way, the electronic device may transmit the user's voice to the counterpart electronic device using the second sound input device 320, instead of using the first sound input device 310 when the first sound input device 310 is blocked.

Figure 4:
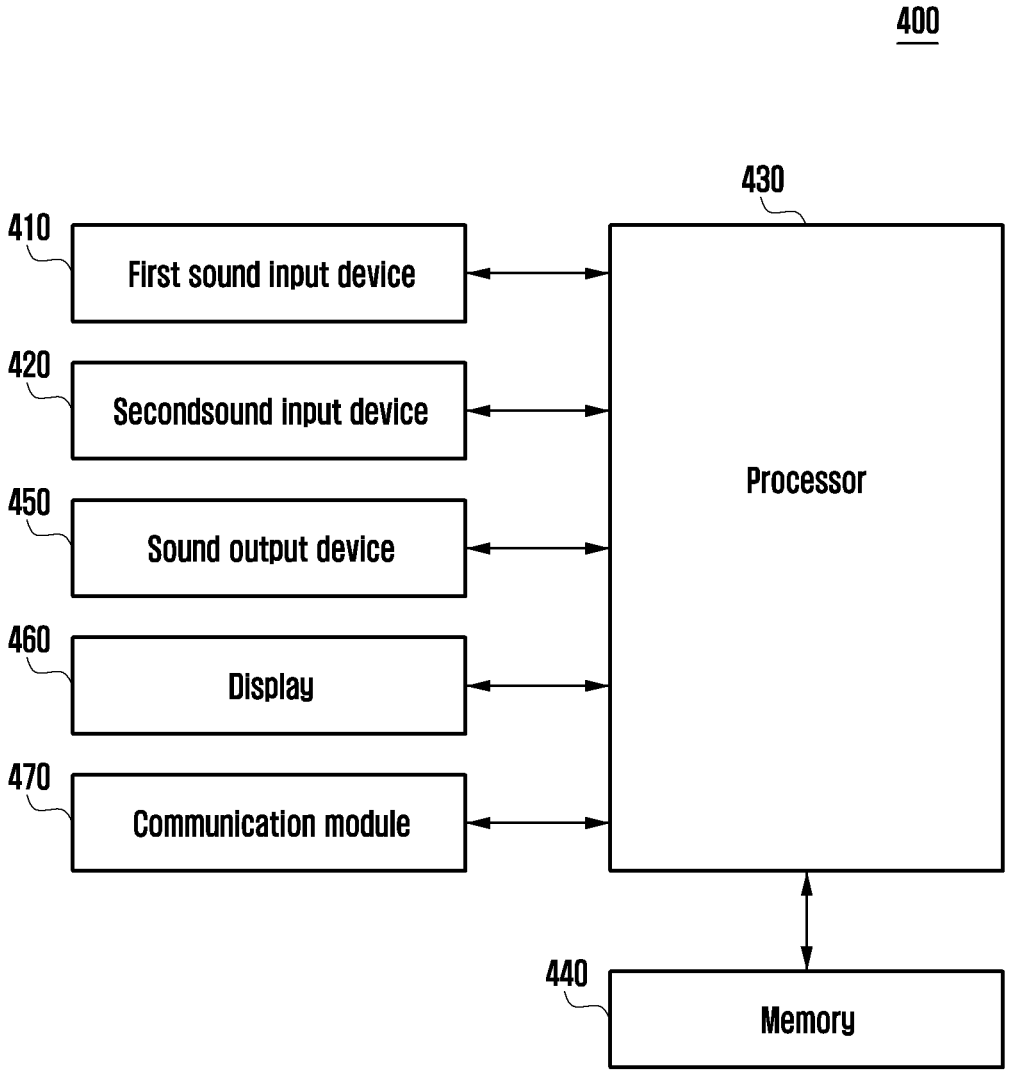
FIG. 4 is a block diagram of an electronic device according to an embodiment.

FIG. 4 is a block diagram of an electronic device according to an embodiment.

According to an embodiment, the electronic device 400 may include a first sound input device 410, a second sound input device 420, a sound output device 450, a display 460, a communication module 470, a processor 430, and a memory 440. The configuration of the electronic device 400 is not limited to that shown in FIG. 4, and various embodiments may be implemented even if some of the illustrated elements are omitted or replaced. The electronic device 400 may include at least some of the configuration and/or functions of the electronic device 101 shown in FIG. 1. The processor 430 may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. In addition, it would be recognized that when a general purpose computer accesses code for implementing the processing shown herein, the execution of the code transforms the general purpose computer into a special purpose computer for executing the processing shown herein. Certain of the functions and steps provided in the Figures may be implemented in hardware, software or a combination of both and may be performed in whole or in part within the programmed instructions of a computer. No claim element herein is to be construed under the provisions of 35 U.S.C. § 112(f), unless the element is expressly recited using the phrase "means for." In addition, an artisan understands and appreciates that a "processor" or "microprocessor" may be hardware in the claimed disclosure. Under the broadest reasonable interpretation, the appended claims are statutory subject matter in compliance with 35 U.S.C. § 101.

According to an embodiment, the electronic device 400 may include one or more sound input devices. Although FIG. 4 illustrates that the electronic device 400 includes a first sound input device 410 and a second sound input device 420, the electronic device may include only a single sound input device, or may include three or more sound input devices.

According to an embodiment, the first sound input device 410 may obtain external sounds to produce a first signal, and the second sound input device 420 may obtain external sounds to produce a second signal. The first sound input device 410 and the second sound input device 420 may obtain sounds in various bands, such as narrowband (e.g., 0 to 4 kHz), wideband (e.g., 0 to 8 kHz), or super wideband (e.g., 0 to 16 kHz). The first sound input device 410 and the second sound input device 420 may be implemented using conventional microphones. The first sound input device 410 may be provided at the lower end of the housing of the electronic device 400, and the second sound input device 420 may be provided at the upper end of the housing of the electronic device 400, as shown in FIG. 2. To enable sound collection, the first sound input device 410 and the second sound input device 420 may be exposed to the outside through holes provided in the housing of the electronic device 400.

According to an embodiment, the sound output device 450 may output sound data received from the processor 430. The sound output device 450 may include a digital-to-analog (D/A) converter (e.g., the D/A converter 351 in FIG. 3A) for converting a digital sound signal into an analog signal. The sound output device 450 may be implemented as a conventional device for outputting sound, such as a speaker, a receiver, earphones, or the like. The sound output device 450 may output the voice of the other party received from the counterpart electronic device during a call. According to an embodiment, the sound output device 450 may provide the user with audible feedback in order to inform that the first sound input device 410 is blocked.

According to an embodiment, the display 460 may output a variety of image data produced by the processor 430. The display 460 may be implemented as one of a liquid crystal display (LCD), a light-emitting diode (LED) display, an organic light-emitting diode (OLED) display, a micro-electromechanical systems (MEMS) display, or an electronic paper display, but is not limited thereto. The display 460 may include at least some of the configuration and/or functions of the display device 160 shown in FIG. 1. According to an embodiment, the display 460 may provide the user with visual feedback in order to inform that the first sound input device 410 is blocked According to an embodiment, the communication module 470 may include software and/or hardware modules for wireless communication with other devices (e.g., the counterpart electronic device, a server, etc.) through a network (e.g., the network 199 in FIG. 1), and may include at least some of the configuration and/or functions of the wireless communication module 192 in FIG. 1. The communication module 470 may support cellular communication (e.g., LTE or the like) and wireless LAN communication (e.g., Wi-Fi or the like), and may provide data received from the processor 430 to other external devices through the network. The communication module 470 may transmit sound signals obtained from the first sound input device 410 and/or the second sound input device 420 to the counterpart electronic device during a voice call, and may provide the sound signal received from the counterpart electronic device to the sound output device 450.

According to an embodiment, the memory 440 may include a volatile memory and a non-volatile memory, which are known, though the specific implementation thereof is not so limited. The memory 440 may include at least some of the configuration and/or functions of the memory 130 in FIG. 1. In addition, the memory 440 may store at least some of the programs 140 in FIG. 1.

The memory 440 may be operatively, functionally, and/or electrically connected to the processor 430, and may store a variety of instructions to be performed by the processor 430. Such instructions may include control commands, such as arithmetic and logical operations, data transfer, input/output, and the like, which can be recognized by the processor 430.

According to an embodiment, the processor 430 may perform the operation or data processing relating to the control and/or communication of the respective components of the electronic device 400, and may include at least some of the configuration and/or functions of the processor 120 in FIG. 1. The processor 430 may be operatively, functionally, and/or electrically connected to the components inside the electronic device 400, such as the first sound input device 410, the second sound input device 420, the sound output device 450, the display 460, the communication module 470, and the memory 440.

Hereinafter, various embodiments for detecting whether or not the first sound input device 410 is blocked based on a first signal received from the first sound input device 410 and/or a second signal received from the second sound input device 420 will be described. The operation of the processor 430 may be performed by loading instructions stored in the memory 440. However, the instant application is not limited to the embodiments described below.

According to an embodiment, the processor 430 may receive a first signal from the first sound input device 410, and may receive a second signal from the second sound input device 420.

According to an embodiment, the processor 430 may detect whether or not the first sound input device 410 is blocked based at least on the received first signal and/or second signal. The processor 430 may produce a first result, a second result, and/or a third result in relation to the blocked state of the first sound input device 410 through signal processing on the first signal and/or the second signal.

Hereinafter, processes of deriving the first result to the third result will be described in three embodiments. The first to third embodiments are not independent from each other, and all of the first to third embodiments may be performed by the processor 430. For example, the processor 430 may determine that the first sound input device 410 is blocked based on at least one of the first result to the third result (e.g., the first result, the second result, the third result, the first result and the second result, the first result and the third result, the second result and the third result, or the first result to the third result). In this document, the method of detecting whether or not the first sound input device 410 is blocked will be described, but the same method may be applied to the second sound input device 420 to determine whether it is blocked.

According to a first embodiment, the processor 430 may produce a first value, based on a first high-frequency component signal obtained by passing a signal through a high-pass filter, and may compare the produced first value with a first threshold value, thereby producing a first result.

If the first sound input device 410 is blocked by the user's finger or the like, the energy of the first signal produced by the first sound input device 410 may be significantly reduced. In particular, this physical shielding may reduce energy in the middle and high band frequencies.

In order to detect a high-frequency signal of the first signal, the processor 430 may pass the first signal through a high-pass filter to produce a first high-frequency signal. The high-pass filter may be designed to have a cutoff frequency of about 6 kHz, and the first high-frequency signal may include only the signal components of about 6 kHz or more of the first signal. According to other embodiments, the cutoff frequency used in the high-pass filter is not limited to 6 kHz, and other frequencies may be used.

The processor 430 may determine an energy value of the first high-frequency signal. The energy value may be the root mean square (RMS) energy value of the first high-frequency signal. The processor 430 may average the energy values of the first high-frequency signal at predetermined intervals in order to minimize noise in the signal caused by sudden changes in the energy.

The processor 430 may then determine an energy value of the entire first signal.

The processor 430 may multiply the energy value of the first signal by the energy value of the first high-frequency signal, may compare the obtained value with a first threshold value to produce a first result. The processor 430 may compare the product of the energy value of the first signal and the energy value of the first high-frequency signal with the first threshold value at various time periods in order to determine a normal period when the first sound input device 410 is operating normally and a period in which the first sound input device 410 is blocked.

If the product of the energy value of the first signal and the energy value of the first high-frequency signal is less than the first threshold, the processor 430 may output a first result indicating that the first sound input device 410 is blocked.

The above-described first embodiment is the process of determining whether or not the sound input device is blocked by identifying that the energy of the first high-frequency signal, which is the high-frequency component of the first signal, is reduced. However, since the high-frequency component of the first signal is weak in a quiet environment (e.g., the state in which the user is not talking during a voice call), false detection may occur. Accordingly, the processor 430 may further use methods of the second and third embodiments, which will be described below, thereby more accurately identifying whether or not the first sound input device 410 is blocked. According to another embodiment, if the energy value of the first signal is greater than or equal to a predetermined threshold value, the processor 430 may simply use the first result to determine that the first sound input device 410 is blocked.

The first embodiment will be described in more detail with reference to FIGS. 5 and 6.

According to the second embodiment, the processor 430 may compare a second value produced based on a first low-frequency component signal obtained by passing the first signal through a low-pass filter with a second threshold value, thereby producing a second result.

If the hole through which the first sound input device 410 is provided is blocked by the user's finger or the like, the energy in the low-frequency band (e.g., 50 Hz or less) tends to increase. Accordingly, if the first sound input device 410 is blocked, the second embodiment uses the increase in the low-frequency band energy as a condition for determining whether or not the sound input device is blocked.

In order to produce the low-frequency signal of the first signal, the processor 430 may pass the first signal through a low-pass filter, thereby producing a first low-frequency signal. The low-pass filter may be designed to have a cutoff frequency of about 50 Hz, so that the first low-frequency signal may include only signal components of about 50 Hz or less of the first signal.

The processor 430 may obtain a ratio of the energy value of the first low-frequency signal to the energy value of the first signal, and may compare the obtained ratio with a second threshold value, thereby producing a second result. Since the energy in the low-frequency band is low in the normal state in which the first sound input device 410 is not blocked, there may be a big difference between the energy value of the first signal and the energy value of the first low-frequency signal when the first sound input device 410 is not blocked. The causes the ratio in the normal state to be relatively small. On the other hand, the energy in the low-frequency band increases in the case where the first sound input device 410 is blocked, and the ratio of the energy value of the first low-frequency signal to the energy value of the first signal (energy value of first low-frequency signal÷energy value of first signal) may increase. Thus, if the ratio of the energy value of the first low-frequency signal to the energy value of the first signal is greater than a second threshold value, the processor 430 may output a second result indicating that the first sound input device 410 is blocked.

In the second embodiment, in order to reduce computation, the processor 430 may calculate the ratio with respect to the first low-frequency signal using only a signal in a partial band (e.g., narrowband), instead of using the energy value of the overall band of the first signal. For example, the processor 430 may produce a second low-frequency signal (or a narrowband signal) by passing the first signal through a second low-pass filter having a cutoff frequency (e.g., 4 kHz or 1 kHz) higher than the cutoff frequency (e.g., 50 Hz) of the low-pass filter used for obtaining the first high-frequency signal. The processor 430 may compare the ratio of the energy value of the first low-frequency signal to the energy value of the second low-frequency signal (energy value of first low-frequency signal÷energy value of second low-frequency signal) with a second threshold value, and if the ratio of the energy value of the first low-frequency signal to the energy value of the second low-frequency signal is greater than the second threshold value, may output the second result indicating that the first sound input device 410 is blocked. According to another embodiment, in order to reduce computation, the processor 430 may perform down-sampling with respect to the first signal to then obtain the ratio with respect to the first low-frequency signal.

The second embodiment will be described in more detail with reference to FIGS. 7 and 8.

According to the third embodiment, the processor 430 may produce a third result, based on the difference between the energy value of the second high-frequency signal obtained by passing the first signal through another high-pass filter and the energy value of the third high-frequency signal obtained by passing the second signal through the other high-pass filter.

Since the first sound input device 410 is provided at the lower end of the housing of the electronic device 400 and the second sound input device 420 is provided at the upper end of the housing of the electronic device 400, the first sound input device 410 located at the lower end of the housing of the electronic device 400 may be closer to the user's mouth when the user performs a voice call using the electronic device 400. If the first sound input device 410 is blocked during the voice call, the signal of the second sound input device 420 may be stronger than the signal of the first sound input device 410. Therefore, the processor 430 may determine whether or not the first sound input device 410 is blocked, based on the difference between the energy value of the first signal and the energy value of the second signal.

In this case, there may be a small difference in the energy value between the first signal and the second signal if the first sound input device 410 is blocked in a quiet environment (e.g., the state in which the user is not talking during a voice call). In order to overcome this problem, the processor 430 may eliminate the boosting effects of DC signals of the first and second signals and the low-frequency band thereof. More specifically, the processor 430 may pass the first signal and the second signal through a high-pass filter to obtain a second high-frequency signal and a third high-frequency signal from which the boosting effects of the DC signal and the low-frequency band have been removed. In this case, the cutoff frequency of the high-pass filter may be a frequency (e.g., 50 Hz to 100 Hz) appropriate to remove the boosting effects of the DC signal and the low-frequency band.

The processor 430 may compare the difference between the second high-frequency signal, which is a high-frequency signal of the first signal, and the third high-frequency signal, which is a high-frequency signal of the second signal, with a third threshold value, and may produce a third result according to the comparison result. If the difference between the second high-frequency signal and the third high-frequency signal is greater than the third threshold value, the processor 430 may output a third result indicating that the first sound input device 410 is blocked.

The third embodiment will be described in more detail with reference to FIGS. 9 and 10.

According to the above embodiments, the processor 430 may determine whether or not the first sound input device 410 is blocked, based on at least one of the first result, the second result, and the third result. For example, if all of the first result, the second result, and the third result show that the first sound input device 410 is blocked, the processor 430 may determine that the first sound input device 410 is blocked.

According to an embodiment, if it is determined that the first sound input device 410 is blocked, based on that the first result, the second result, and the third result, the processor 430 may perform an operation corresponding to the blocked state of the first sound input device 410.

According to an embodiment, the processor 430 may provide feedback corresponding to the blocked state of the first sound input device 410 using the display 460 and/or the sound output device 450. For example, the processor 430 may provide a notification sound through the sound output device 450 in order to inform that the first sound input device 410 is in a blocked state. In this case, the other party of the voice call cannot hear the user's voice, and the user may recognize the notification sound, and may correct the gripping state of the electronic device 400, thereby enabling a normal voice call.

According to an embodiment, the processor 430 may store event information corresponding to the blocked state in the memory 440. For example, whenever the user blocks the first sound input device 410 during a voice call, the processor 430 may record the blocked state and the duration thereof, and may then provide the user with call habit and pattern information. According to another embodiment, the processor 430 may transmit block event information corresponding to the blocked state to an external server (e.g., the server 108 in FIG. 1) through the communication module 470, and the block event information obtained from the electronic device 400 may be stored in a database of the external server.

According to an embodiment, if the first sound input device 410 is blocked, the processor 430 may perform the voice call using the second signal obtained by the second sound input device 420. For example, the processor 430 may open the path of the switch 339 in FIG. 3B such that the first signal is not transmitted to the TX processor (e.g., the TX processor 331 in FIG. 3B). Accordingly, the electronic device 400 may transmit the voice of the user to the counterpart electronic device using the second sound input device 420, instead of using the first sound input device 410, which is blocked. In this case, the other party may detect a difference in call quality because the sound input device used in the voice call was changed, but he or she can at least still seamlessly hear the user even though a sound input device is blocked. At the same time, if a notification sound is provided to the user through the sound output device 450, the user may recognize the same, and may correct the gripping state of the electronic device 400, thereby enabling a normal voice call.

The first embodiment, the second embodiment, and the third embodiment will be described in more detail below. The operations described below in the respective embodiments may be performed by a single electronic device or multiple electronic devices.

Figure 5:
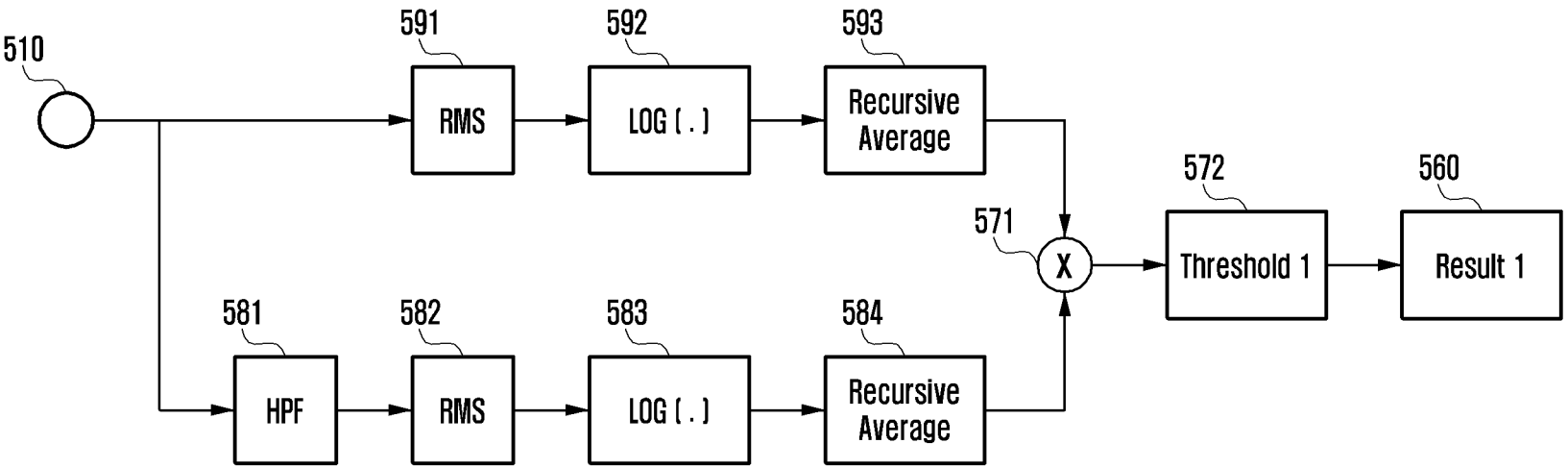
FIG. 5 is a block diagram of an electronic device according to a first embodiment.

FIG. 5 is a block diagram of an electronic device according to the first embodiment.

If the first sound input device 510 is blocked by the user's finger or the like, the energy of a first signal produced by the first sound input device 510 may significantly decrease, and in particular, the energy may be reduced in the middle- and high-frequency bands. In the first embodiment, it is possible to determine whether or not the first sound input device 510 is blocked by accurately detecting the decrease in the energy of the middle- and high-frequency bands of the first signal. Hereinafter, the method of determining whether or not the first sound input device 410 is blocked will be described, but the same method may be applied to detect whether or not the second sound input device 420 is blocked.

According to an embodiment, the electronic device may collect external sounds to produce a first signal using the first sound input device 510. Although it is illustrated in FIG. 5 that the electronic device includes only the first sound input device 510, the electronic device may further include another sound input device (e.g., the second sound input device 420 in FIG. 4).

According to an embodiment, the electronic device may produce a first high-frequency signal by passing the first signal through a high-pass filter (HPF) 581. Here, since the high-pass filter 581 is designed to have a cutoff frequency of about 6 kHz in order to extract the high-frequency component of the first signal, and the first high-frequency signal may include only the signal components of about 6 kHz or more of the first signal. According to other embodiments, the cutoff frequency used in the high-pass filter is not limited to 6 kHz, and other frequencies may be used.

The high-pass filter 581 may be implemented as a software filter executed by a processor (e.g., the processor 430 in FIG. 4) filter, or may be implemented as a hardware filter circuit separate from the processor.

Figure 6A:
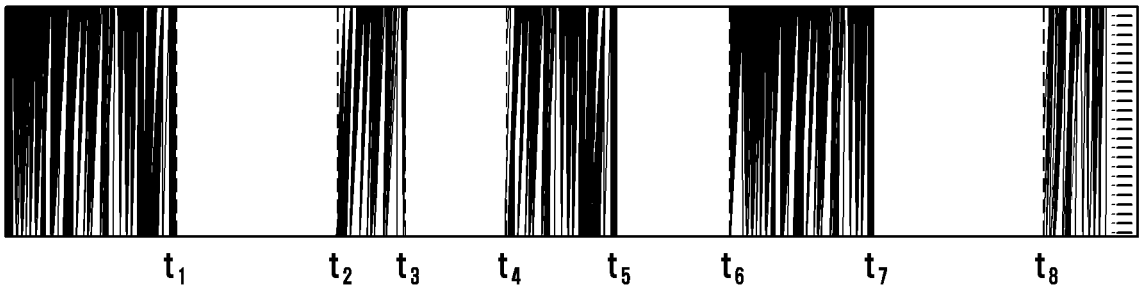
FIG. 6A is a graph of a first signal processed by the electronic device according to the first embodiment.

An example of the first signal is shown in FIG. 6A. In FIG. 6A, the x-axis represents time, and the y-axis represents signal strength. FIG. 6A illustrates the state in which the first sound input device 510 is blocked in the periods t1-t2, t3-t4, and t5-t6.

The electronic device may determine an energy value 591 of the first signal. The energy value of the first signal may be a root mean square (RMS) energy value of the first signal, and the energy value of the first signal may be averaged in the same interval unit as the first high-frequency signal.

Figure 6B:
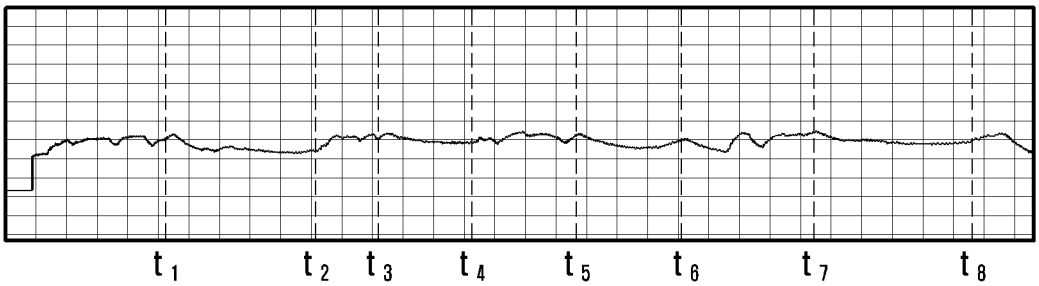
FIG. 6B is a graph of the root mean square (RMS) energy value of the first signal according to the first embodiment.

FIG. 6B shows a graph of the RMS energy value of the first signal.

The electronic device may determine an energy value 582 of the first high-frequency signal. The energy value may be a root mean square (RMS) energy value of the first high-frequency signal. The processor may average the energy values of the first high-frequency signal at predetermined intervals in order to minimize noise caused by sudden changes in the energy.

Figure 6C:
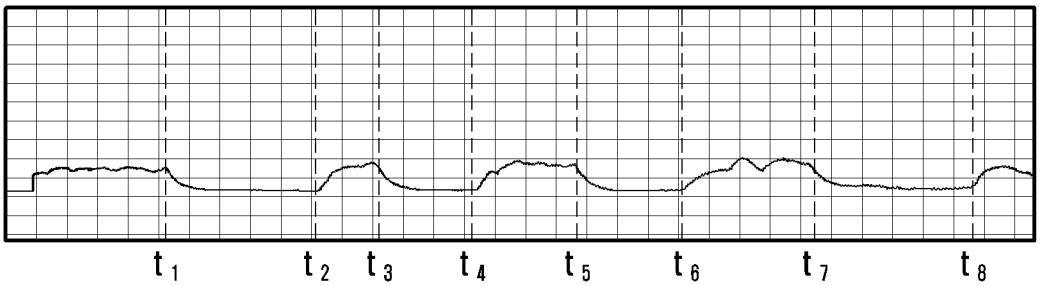
FIG. 6C is a graph of the root mean square (RMS) energy value of a first high-frequency component of the first signal according to the first embodiment.

FIG. 6C illustrates a graph of an RMS energy value of the first high-frequency signal. Referring to FIG. 6C, it can be seen that the high-frequency band components are somewhat low in the periods t1-t2, t3-t4, and t5-t6.

The electronic device may convert the produced energy value of the first high-frequency signal to a logarithmic scale 583, and may obtain an average value of the converted value (e.g., a recursive average) 584. The electronic device may convert the produced energy value of the first signal to a logarithmic scale 592, and may obtain a recursive average of the converted value 593.

The electronic device may multiply the energy value of the first signal (or the recursive average of the energy value of the first signal) and the energy value of the first high-frequency signal (or the recursive average of energy value of the first high-frequency signal) at 571.

Figure 6D:
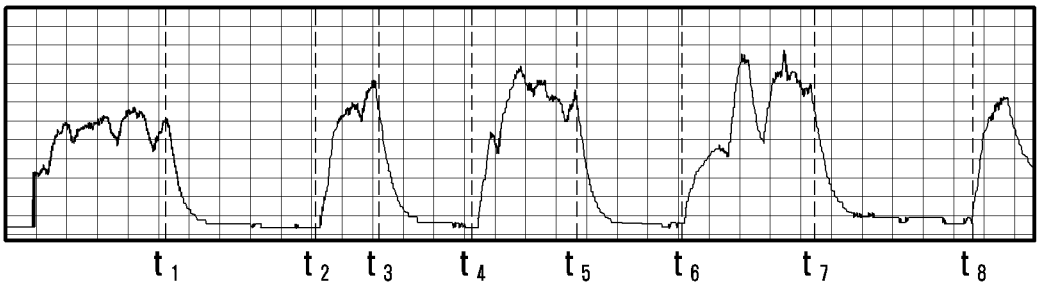
FIG. 6D is a graph of a product of the energy value of the first signal and the energy value of the first high-frequency component of the first signal according to the first embodiment.

FIG. 6D shows a graph of a product of the energy value of the first signal and the energy value of the first high-frequency signal. Referring to FIG. 6D, it can be seen that the difference in the values between the periods t1-t2, t3-t4, and t5-t6 in which the first sound input device 510 is blocked and the periods before t1, t2-t3, and t4-t5 in which the first sound input device 510 is not blocked on the y-axis is greater than that shown in FIG. 6C. As described above, in order to maximize the difference between the normal periods and the periods in which the first sound input device 510 is blocked, the electronic device may multiply the energy value of the first signal (or the recursive average of the energy value of the first signal) and the energy value of the first high-frequency signal (or the recursive average of energy value of the first high-frequency signal).

The electronic device may compare the value obtained by multiplying the energy value of the first signal (or the recursive average of the energy value of the first signal) and the energy value of the first high-frequency signal (or the recursive average of energy value of the first high-frequency signal) with a first threshold value 572, thereby outputting a first result 560. If the product 571 of the energy value of the first signal and the energy value of the first high-frequency signal is lower than the first threshold value 572, the electronic device may output a first result 560 indicating that the first sound input device 510 is blocked.

In FIG. 6D, the electronic device may determine the periods before t1, t2-t3, and t4-t5 to be normal periods because the product of the energy value of the first signal and the energy value of the first high-frequency signal is greater than the first threshold value therein, and may determine the periods t1-t2, t3-t4, and t5-t6 to be the periods in which the first sound input device 510 is blocked because the product of the energy value of the first signal and the energy value of the first high-frequency signal is less than the first threshold value therein.

Figure 7:
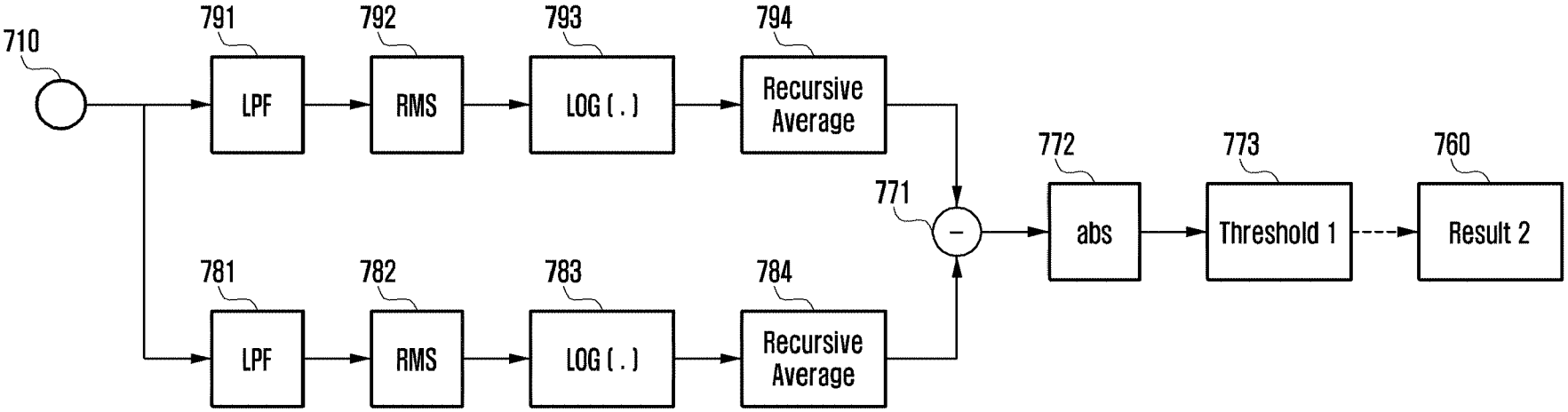
FIG. 7 is a block diagram of an electronic device according to a second embodiment.

FIG. 7 is a block diagram of an electronic device according to the second embodiment.

If the hole through which the first sound input device 710 is provided is blocked by the user's finger or the like, the energy in the low-frequency band (e.g., 50 Hz or less) tends to increase. Accordingly, in the second embodiment, it is possible to identify whether or not a first sound input device 710 is blocked based on an increase in the energy in the low-frequency band.

Figure 8A:
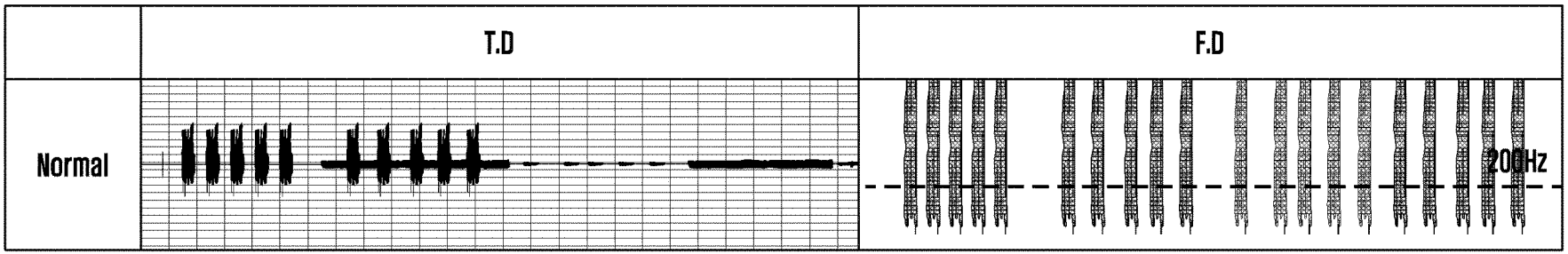
FIG. 8A is a time and frequency domain spectrogram of a first signal where a sound input device is not blocked according to the second embodiment.
Figure 8B:
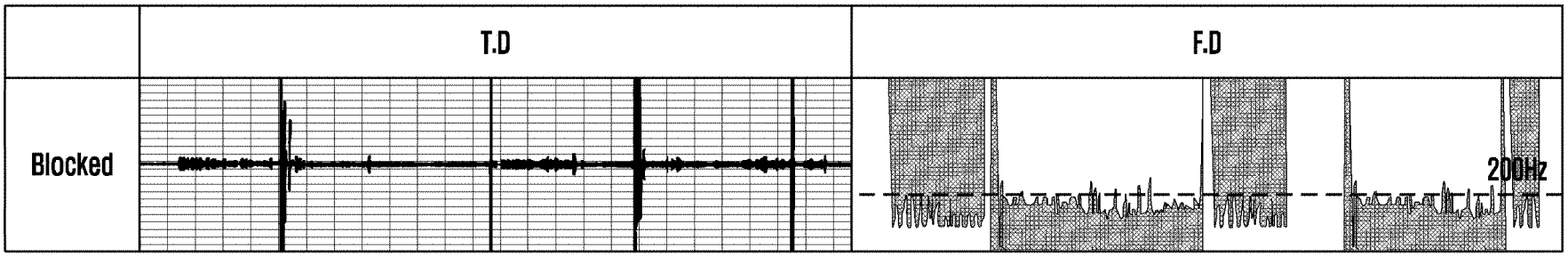
FIG. 8B is a time and frequency domain spectrogram of the first signal where the sound input device is blocked at times according to the second embodiment.

FIG. 8A is a time and frequency domain spectrogram of a first signal in the state in which the first sound input device 710 is not blocked, and FIG. 8B is a time and frequency domain spectrogram of a first signal in the state in which the first sound input device 710 is blocked in some periods. Referring to FIGS. 8A and 8B, it can be seen that the energy value of the low-frequency band is more dominant in FIG. 8B.

According to an embodiment, the electronic device may collect external sounds to produce a first signal using the first sound input device 710.

In order to obtain a low-frequency signal of the first signal, the electronic device may pass the first signal through a first low-pass filter 781 having a first cutoff frequency, thereby producing a first low-frequency signal. The first cutoff frequency may be set to about 50 Hz in order to detect the low-frequency band that increases when the first sound input device 710 is blocked. According to other embodiments, the first cutoff frequency used in the first low-pass filter is not limited to 50 Hz, and other frequencies may be used.

The electronic device may pass the first signal through a second low-pass filter 791 having a second cutoff frequency, thereby producing a second low-frequency signal. The second low-frequency signal is in partial bands (e.g., narrowband) in order to reduce computation. The second cutoff frequency of the second low-pass filter 791 may have a higher value (4 kHz or 1 kHz) than the first cutoff frequency (e.g., 50 Hz). According to other embodiments, the electronic device may detect whether or not first sound input device 710 is blocked using the first signal and the first low-frequency signal, instead of producing the second low-frequency signal.

The electronic device may obtain an RMS energy value 782 of the first low-frequency signal. The electronic device may convert the RMS energy value of the first low-frequency signal to a logarithmic scale 783, and may obtain a recursive average of the converted value 784.

The electronic device may obtain an RMS energy value 792 of the second low-frequency signal. The electronic device may convert the RMS energy value of the second low-frequency signal to a logarithmic scale 793, and may obtain a recursive average of the converted value 794.

The electronic device may obtain the ratio 771 of the energy value of the first low-frequency signal (or the recursive average of the logarithm of the energy value of the first low-frequency signal) to the energy value of the second low-frequency signal (or the recursive average of the logarithm of the energy value of the second low-frequency signal). In another example, the electronic device may obtain the difference between the energy value of the first low-frequency signal (or the recursive average of the logarithm of the energy value of the first low-frequency signal) and the energy value of the second low-frequency signal (or the recursive average of the logarithm of the energy value of the second low-frequency signal).

If an absolute value 772 of the ratio 771 of the energy value of the first low-frequency signal to the energy value of the second low-frequency signal is greater than a second threshold value 773, the electronic device may output a second result 760 indicating that first sound input device 710 is blocked.

Figure 8C:
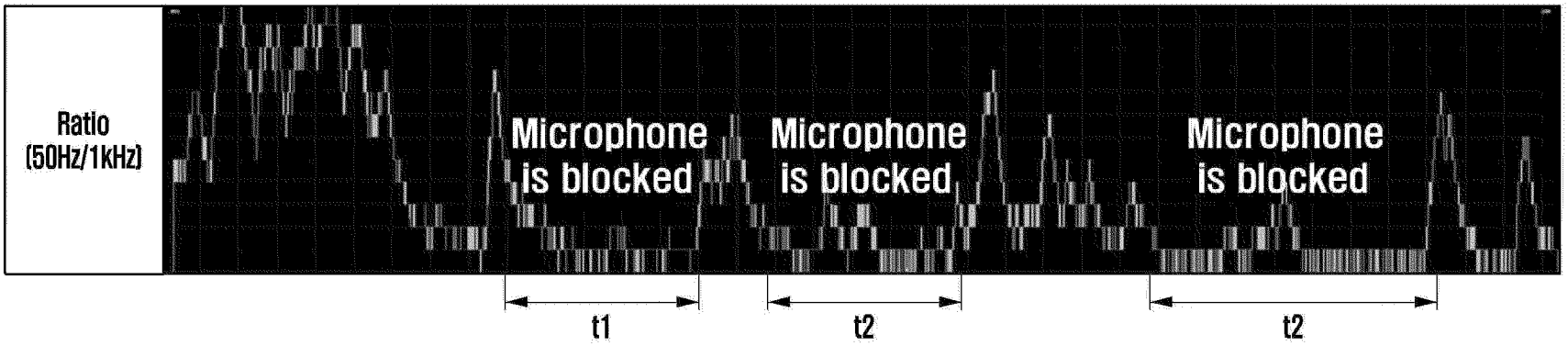
FIG. 8C is a graph showing the ratio of the energy value of a first low-frequency signal to the energy value of a second low-frequency signal according to the second embodiment.

FIG. 8C is a graph showing the ratio of the energy value of the first low-frequency signal to the energy value of the second low-frequency signal. Since the logarithmic scale is used in FIG. 8C, the ratio may be greater in low-value periods in the graph. The electronic device may determine that first sound input device 710 is blocked in the periods t1, t2, and t3 in which the ratio of the energy value of the first low-frequency signal to the energy value of the second low-frequency signal is less than a second threshold value in the graph shown in FIG. 8C.

Figure 9:
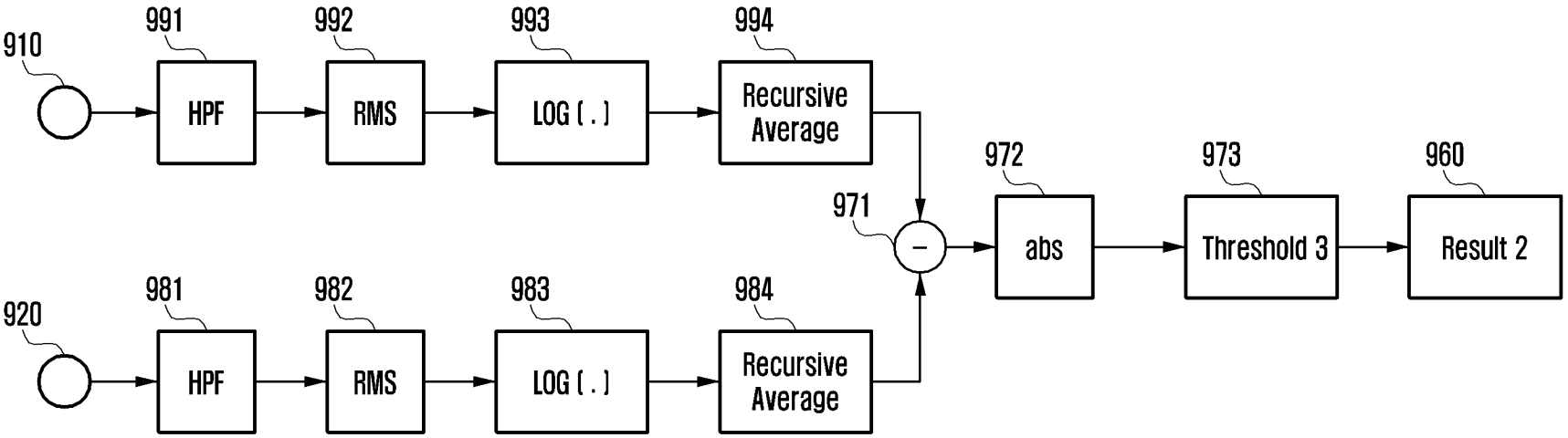
FIG. 9 is a block diagram of an electronic device according to a third embodiment.

FIG. 9 is a block diagram of an electronic device according to the third embodiment.

According to an embodiment, a first sound input device 910 may be provided at the lower end of the housing of the electronic device, and a second sound input device 920 may be provided at the upper end of the housing of the electronic device. The first sound input device 910 located at the lower end of the housing of the electronic device may be closer to the user's mouth when the user performs a voice call using the electronic device. If the first sound input device 910 is blocked during the voice call, the signal of the second sound input device 920 may be stronger than the signal of the first sound input device 910. Therefore, the electronic device may determine whether or not the first sound input device 910 is blocked, based on the difference between the energy value of the first signal and the energy value of the second signal in the third embodiment.

The electronic device may obtain a first signal from the first sound input device 910, and may obtain a second signal from the second sound input device 920.

The electronic device may pass the first signal through a high-pass filter 991 to obtain a second high-frequency signal, and may pass the second signal through a high-pass filter 981 to obtain a third high-frequency signal. The high-pass filters 981 and 991 used for the first signal and the second signal may have the same cutoff frequency of, for example, 50 Hz to 100 Hz, which is appropriate for removing the boosting effects of DC signal and low-frequency band in the first and second signals.

The electronic device may obtain an RMS energy value 992 of the second high-frequency signal. The electronic device may convert the RMS energy value of the first low-frequency signal to a logarithmic scale 993, and may obtain a recursive average of the converted value 994.

The electronic device may obtain an RMS energy value 982 of the third high-frequency signal. The electronic device may convert the RMS energy value of the second low-frequency signal to a logarithmic scale 983, and may obtain a recursive average of the converted value 984.

The electronic device may obtain the difference 971 between the energy value of the second high-frequency signal (or the recursive average of the logarithm of the energy value of the second high-frequency signal) and the energy value of the third high-frequency signal (or the recursive average of the logarithm of the energy value of the third high-frequency signal).

The electronic device may compare the obtained difference value with a third threshold value, and may produce a third result according to the comparison result. If the difference between the second high-frequency signal and the third high-frequency signal (or an absolute value thereof) is greater than the third threshold value 973, the processor may output a third result 960 indicating that the first sound input device 910 is blocked.

Figure 10A:
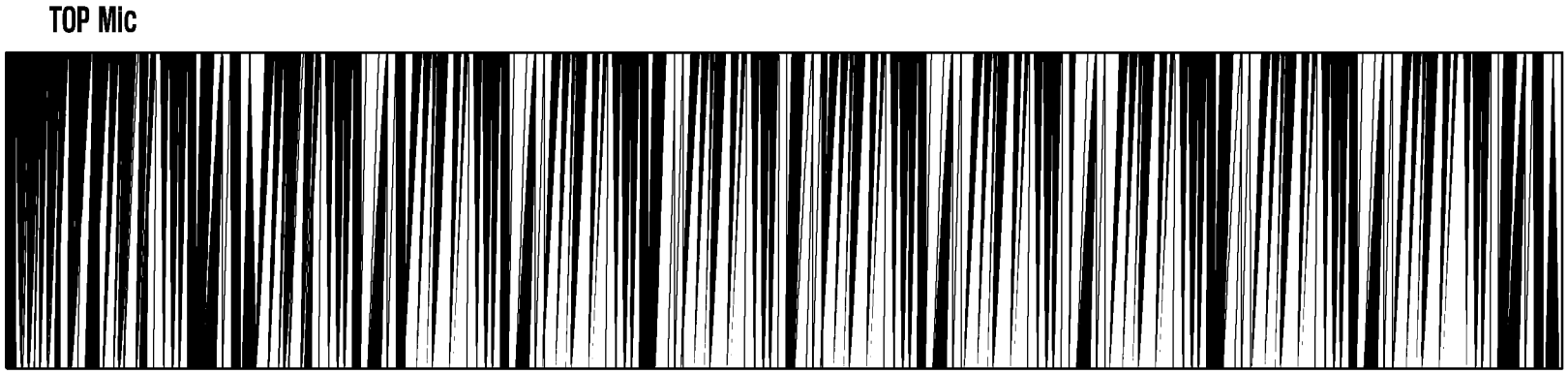
FIG. 10A is a spectrogram of a second signal according to the third embodiment.
Figure 10B:
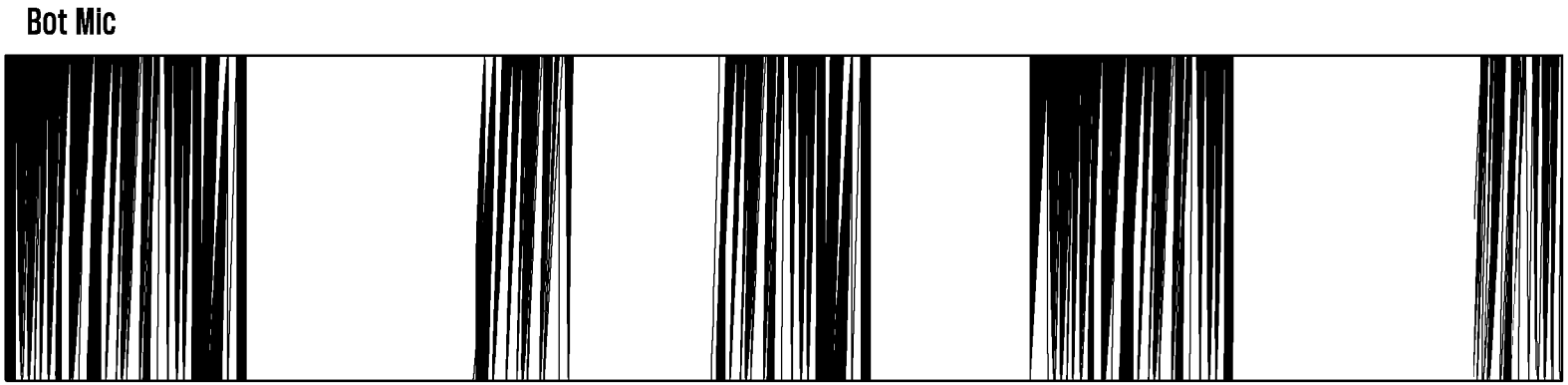
FIG. 10B is a spectrogram of a first signal according to the third embodiment.

FIG. 10A is a spectrogram of a second signal, and FIG. 10B is a spectrogram of a first signal.

Figure 10C:
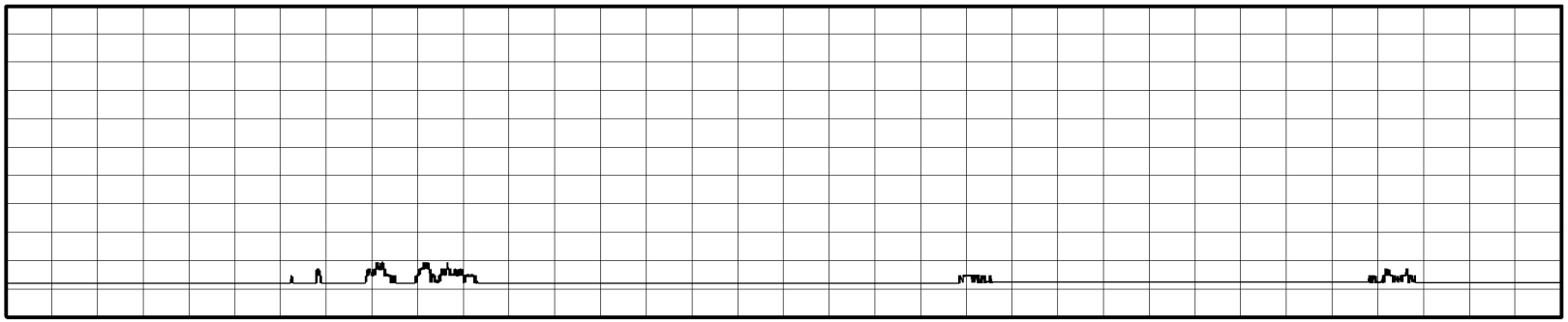
FIG. 10C is a graph illustrating the difference between the energy value of the second signal and the energy value of the first signal according to the third embodiment.

FIG. 10C illustrates the difference between the energy value of the second signal and the energy value of the first signal. Referring to FIG. 10C, even though the first sound input device 910 is blocked, the difference between the energy value of the second signal and the energy value of the first signal is not great.

Figure 10D:
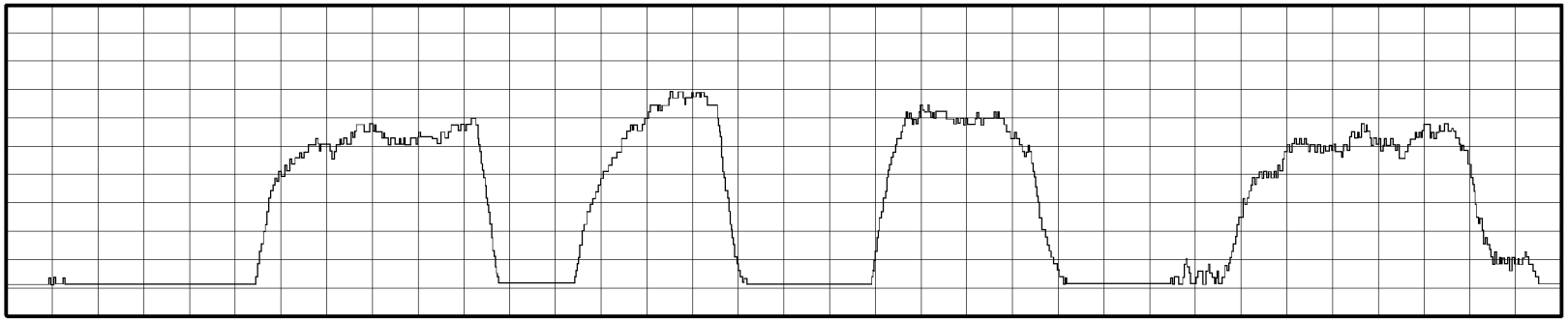
FIG. 10D is a graph illustrating the difference between the energy value of a second high-frequency signal and the energy value of a third high-frequency signal according to the third embodiment.

FIG. 10D illustrates the difference between the energy value of the second high-frequency signal (or the recursive average of the logarithm of the energy value of the second high-frequency signal) and the energy value of the third high-frequency signal (or the recursive average of the logarithm of the energy value of the third high-frequency signal).

Since the electronic device uses the difference between the second high-frequency signal and the third high-frequency signal from which boosting effects of DC signal and low-frequency band are removed, there may be a big difference between the periods in which the first sound input device 910 is blocked and the normal periods as shown in FIG. 10D.

An electronic device 400 according to an embodiment may include: a first sound input device 410 configured to obtain external sound and produce a first signal; and a processor 430 operatively connected to the first sound input device 410, wherein the processor 430 is configured to: receive the first signal from the first sound input device 410; pass the first signal through a first high-pass filter to produce a first high-frequency signal; determine a first energy value of the first high-frequency signal; determine a second energy value of the first signal; compare a product of the second energy value of the first signal and the first energy value of the first high-frequency signal with a first threshold value to produce a first result; and determine whether the first sound input device 410 is blocked based on the first result.

According to an embodiment, the processor 430 may be configured to: pass the first signal through a low-pass filter to produce a first low-frequency signal; obtain a ratio of a third energy value of the first low-frequency signal to the second energy value of the first signal; compare the obtained ratio with a second threshold value to produce a second result; and determine whether the first sound input device is blocked based on the first result and the second result.

According to an embodiment, the processor 430 may be configured to: pass the first signal through a first low-pass filter having a first cutoff frequency to produce a first low-frequency signal; pass the first signal through a second low-pass filter having a second cutoff frequency higher than the first cutoff frequency to produce a second low-frequency signal; compare a ratio of a third energy value of the first low-frequency signal to a fourth energy value of the second low-frequency signal with a second threshold value to produce a second result; and determine whether the first sound input device 410 is blocked based on the first result and the second result.

According to an embodiment, the electronic device may further include a second sound input device 420 configured to obtain external sound and produce a second signal, wherein the processor 430 may be configured to: receive the second signal from the second sound input device 420; compare a difference between a third energy value of the second signal and the second energy value of the first signal with a third threshold value to produce a third result; and determine whether the first sound input device 410 is blocked based on the first result and the third result.

According to an embodiment, the electronic device may further include a second sound input device 420 configured to obtain external sound and produce a second signal, wherein the processor 430 may be configured to: receive the second signal from the second sound input device 420; pass the first signal through a second high-pass filter to produce a second high-frequency signal; pass the second signal through the second high-pass filter or a third high-pass filter to produce a third high-frequency signal; compare a difference between a third energy value of the second high-frequency signal and a fourth energy value of the third high-frequency signal with a third threshold value to produce a third result; and determine whether the first sound input device 410 is blocked based on the first result and the third result.

According to an embodiment, the processor 430 may be configured to determine whether or not the first sound input device 410 is blocked during a voice call.

According to an embodiment, the electronic device may further include a second sound input device 420 configured to obtain external sound and produce a second signal, wherein the processor 430 is configured to perform the voice call based on the second signal obtained by the second sound input device 420 when the first sound input device 410 is blocked.

According to an embodiment, the electronic device may further include a memory 440, wherein when the first sound input device 410 is blocked in a blocked state, the processor 430 is configured to store event information corresponding to the blocked state in the memory 440.

According to an embodiment, the electronic device may further include a display 460 and a sound output device 450, wherein the processor 430 may be configured to, when the first sound input device 410 is blocked, provide feedback using the display 460 and/or the sound output device 450.

An electronic device according to an embodiment may include: a display 460; a memory 440; a sound output device 450; a first sound input device 410 configured to obtain external sound and produce a first signal; a second sound input device 420 configured to obtain external sound and produce a second signal; and a processor 430 operatively connected to the display 460, the memory 440, the sound output device 450, the first sound input device 410, and the second sound input device 420, wherein the processor 430 may be configured to: receive the first signal from the first sound input device 410; compare a first value, produced based on a first high-frequency signal obtained by passing the first signal through a first high-pass filter, with a first threshold value to produce a first result; compare a second value, produced based on a first low-frequency signal obtained by passing the first signal through a low-pass filter, with a second threshold value to produce a second result; determine whether the first sound input device 410 is blocked based on the first result and the second result; and when the first sound input device 410 is blocked in a blocked state, provide feedback corresponding to the blocked state using the display 460 and/or the sound output device 450.

According to an embodiment, the processor 430 may be configured to: receive the second signal from the second sound input device 420; produce a third result, based on a difference between a first energy value of a second high-frequency signal obtained by passing the first signal through a second high-pass filter and a second energy value of a third high-frequency signal obtained by passing the second signal through the second high-pass filter or a third high-pass filter; and determine whether the first sound input device 410 is blocked based on the first result, the second result, and the third result.

According to an embodiment, the processor 430 may be configured to: determine a first energy value of the first high-frequency signal; determine a second energy value of the first signal; and compare a product of the second energy value of the first signal and the first energy value of the first high-frequency signal with the first threshold value to produce the first result.

According to an embodiment, the processor 430 may be configured to: obtain a ratio of a third energy value of the first low-frequency signal to a second energy value of the first signal; and compare the obtained ratio with the second threshold value to produce the second result.

According to an embodiment, the first sound input device 410 may be provided at a lower end of the electronic device 400 and the second sound input device 420 may be provided at an upper end of the electronic device 400.

According to an embodiment, the processor 430 may be configured to determine whether the first sound input device 410 is blocked during a voice call connection.

A method of detecting whether a microphone of an electronic device 400 is blocked, according to an embodiment, may include: obtaining external sound using a first sound input device 410 and produce a first signal; passing the first signal through a high-pass filter to produce a first high-frequency signal; determining a first energy value of the first high-frequency signal; determining a second energy value of the first signal; comparing a product of the second energy value of the first signal and the first energy value of the first high-frequency signal with a first threshold value to produce a first result; and determining whether the first sound input device 410 is blocked in a blocked state based on the first result.

According to an embodiment, the method may further include: passing the first signal through a low-pass filter to produce a first low-frequency signal; obtaining a ratio of a third energy value of the first low-frequency signal to the second energy value of the first signal; and comparing the obtained ratio with a second threshold value to produce a second result, wherein the determining of whether the first sound input device 410 is blocked includes determining whether the first sound input device 410 is blocked based on the first result and the second result.

According to an embodiment, the method may further include: passing the first signal through a first low-pass filter having a first cutoff frequency to produce a first low-frequency signal; passing the first signal through a second low-pass filter having a second cutoff frequency higher than the first cutoff frequency to produce a second low-frequency signal; and comparing a ratio of a third energy value of the first low-frequency signal to a fourth energy value of the second low-frequency signal with a second threshold value to produce a second result, wherein the determining of whether the first sound input device 410 is blocked includes determining whether the first sound input device 410 is blocked based on the first result and the second result.

According to an embodiment, the method may further include: obtaining external sound using a second sound input device 420 to produce a second signal; and comparing a difference between a third energy value of the second signal and the second energy value of the first signal with a third threshold value to produce a third result, wherein the determining of whether the first sound input device 410 is blocked includes determining whether the first sound input device 410 is blocked based on the first result and the third result.

According to an embodiment, the method may further include, when the first sound input device 410 is blocked, providing feedback corresponding to the blocked state using a display 460 and/or a sound output device 450.

Certain of the above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

While the present disclosure has been shown and described with reference to various embodiments thereof, it will be understood by those skilled in the art that various changes in form and details may be made therein without departing from the present disclosure as defined by the appended claims and their equivalents.

What is claimed is:

1. An electronic device comprising:
- a first sound input device configured to obtain external sound and produce a first signal; and
- a processor operatively connected to the first sound input device,
- wherein the processor is configured to:
  - receive the first signal from the first sound input device;
  - produce a first high-frequency signal by passing the first signal through a first high-pass filter;
  - determine a first energy value of the first high-frequency signal;
  - determine a second energy value of the first signal;
  - produce a first result by comparing a product of the second energy value of the first signal and the first energy value of the first high-frequency signal with a first threshold value; and
  - determine whether the first sound input device is blocked based on the first result.

2. The electronic device of claim 1, wherein the processor is further configured to:
- pass the first signal through a low-pass filter to produce a first low-frequency signal;
- obtain a ratio of a third energy value of the first low-frequency signal to the second energy value of the first signal;
- compare the obtained ratio with a second threshold value to produce a second result; and
- determine whether the first sound input device is blocked based on the first result and the second result.

3. The electronic device of claim 1, wherein the processor is further configured to:
- pass the first signal through a first low-pass filter having a first cutoff frequency to produce a first low-frequency signal;
- pass the first signal through a second low-pass filter having a second cutoff frequency higher than the first cutoff frequency to produce a second low-frequency signal;
- compare a ratio of a third energy value of the first low-frequency signal to a fourth energy value of the second low-frequency signal with a second threshold value to produce a second result; and
- determine whether the first sound input device is blocked based on the first result and the second result.

4. The electronic device of claim 1, further comprising a second sound input device configured to obtain external sound and produce a second signal, wherein the processor is further configured to:
- receive the second signal from the second sound input device;

compare a difference between a third energy value of the second signal and the second energy value of the first signal with a third threshold value to produce a third result; and determine whether the first sound input device is blocked based on the first result and the third result.

5. The electronic device of claim 1, further comprising a second sound input device configured to obtain external sound and produce a second signal, wherein the processor is further configured to:

receive the second signal from the second sound input device;

pass the first signal through a second high-pass filter to produce a second high-frequency signal;

pass the second signal through the second high-pass filter or a third high-pass filter to produce a third high-frequency signal;

compare a difference between a third energy value of the second high-frequency signal and a fourth energy value of the third high-frequency signal with a third threshold value to produce a third result; and determine whether the first sound input device is blocked based on the first result and the third result.

6. The electronic device of claim 1, wherein the processor is further configured to determine whether or not the first sound input device is blocked during a voice call.

7. The electronic device of claim 6, further comprising a second sound input device configured to obtain external sound and produce a second signal, wherein the processor is further configured to perform the voice call based on the second signal obtained by the second sound input device when the first sound input device is blocked.

8. The electronic device of claim 6, further comprising a memory, wherein when the first sound input device is blocked in a blocked state, the processor is further configured to store event information corresponding to the blocked state in the memory.

9. The electronic device of claim 6, further comprising:

a display; and a sound output device, wherein the processor is further configured to, when the first sound input device is blocked, provide feedback using the display and/or the sound output device.

10. An electronic device comprising:

a display;

a memory;

a sound output device;

a first sound input device configured to obtain external sound and produce a first signal;

a second sound input device configured to obtain external sound and produce a second signal; and a processor operatively connected to the display, the memory, the sound output device, the first sound input device, and the second sound input device, wherein the processor is configured to:

receive the first signal from the first sound input device;

produce a first result by comparing a first value with a first threshold value, the first value produced based on a first low-frequency signal obtained by passing the first signal through a low-pass filter;

determine whether the first sound input device is blocked based on the first result; and when the first sound input device is blocked in a blocked state, provide feedback corresponding to the blocked state using the display and/or the sound output device, and wherein the processor is further configured to:

obtain a ratio of an energy value of the first low-frequency signal to an energy value of the first signal; and compare the obtained ratio with the first threshold value to produce the first result.

11. The electronic device of claim 10, wherein the processor is further configured to:

receive the second signal from the second sound input device;

produce a second result, based on a difference between a first energy value of a first high-frequency signal obtained by passing the first signal through a high-pass filter and a second energy value of a second high-frequency signal obtained by passing the second signal through the high-pass filter; and determine whether the first sound input device is blocked based on the first result and the second result.

12. The electronic device of claim 10, wherein the processor is further configured to:

produce a third result by comparing a second value with a second threshold value, the second value produced based on a first high-frequency signal obtained by passing the first signal through a high-pass filter;

determine a first energy value of the first high-frequency signal;

determine a third energy value of the first signal; and compare a product of the third energy value of the first signal and the first energy value of the first high-frequency signal with the second threshold value to produce the third result.

13. The electronic device of claim 10, wherein the first sound input device is provided at a lower end of the electronic device and the second sound input device is provided at an upper end of the electronic device.

14. The electronic device of claim 10, wherein the processor is further configured to determine whether the first sound input device is blocked during a voice call connection.

15. A method of detecting whether a microphone of an electronic device is blocked, the method comprising:

obtaining external sound using a first sound input device and produce a first signal;

passing the first signal through a high-pass filter to produce a first high-frequency signal;

determining a first energy value of the first high-frequency signal;

determining a second energy value of the first signal;

comparing a product of the second energy value of the first signal and the first energy value of the first high-frequency signal with a first threshold value to produce a first result; and determining whether the first sound input device is blocked in a blocked state based on the first result.

16. The method of claim 15, further comprising:

passing the first signal through a low-pass filter to produce a first low-frequency signal;

obtaining a ratio of a third energy value of the first low-frequency signal to the second energy value of the first signal; and comparing the obtained ratio with a second threshold value to produce a second result, wherein the determining of whether the first sound input device is blocked further comprises determining whether the first sound input device is blocked based on the first result and the second result.

17. The method of claim 15, further comprising:

passing the first signal through a first low-pass filter having a first cutoff frequency to produce a first low-frequency signal;

passing the first signal through a second low-pass filter having a second cutoff frequency higher than the first cutoff frequency to produce a second low-frequency signal; and comparing a ratio of a third energy value of the first low-frequency signal to a fourth energy value of the second low-frequency signal with a second threshold value to produce a second result, wherein the determining of whether the first sound input device is blocked further comprises determining whether the first sound input device is blocked based on the first result and the second result.

18. The method of claim 15, further comprising:

obtaining external sound using a second sound input device to produce a second signal; and comparing a difference between a third energy value of the second signal and the second energy value of the first signal with a third threshold value to produce a third result, wherein the determining of whether the first sound input device is blocked further comprises determining whether the first sound input device is blocked based on the first result and the third result.

19. The method of claim 15, further comprising:

when the first sound input device is blocked, providing feedback corresponding to the blocked state using a display and/or a sound output device.

* * * * *